US006659786B2

(12) United States Patent
Eckel et al.

(10) Patent No.: US 6,659,786 B2
(45) Date of Patent: Dec. 9, 2003

(54) ELECTRICAL CONNECTOR

(75) Inventors: Markus Eckel, Buerstadt (DE); Josef Woller, Griesheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/128,627

(22) Filed: Apr. 23, 2002

(65) Prior Publication Data

US 2002/0192992 A1 Dec. 19, 2002

(30) Foreign Application Priority Data

Apr. 25, 2001 (DE) ..... 101 20 264

(51) Int. Cl.[7] ..... H01R 13/64
(52) U.S. Cl. ..... 439/246
(58) Field of Search ..... 439/246, 247, 439/248, 824, 825, 848

(56) References Cited

U.S. PATENT DOCUMENTS

| | | | | |
|---|---|---|---|---|
| 3,745,514 A | | 7/1973 | Brishka | 439/848 |
| 5,516,303 A | * | 5/1996 | Yohn et al. | 439/248 |
| 5,769,652 A | * | 6/1998 | Wider | 439/248 |
| 5,980,290 A | * | 11/1999 | Meynier et al. | 439/246 |
| 6,146,166 A | * | 11/2000 | Muzslay | 439/176 |

FOREIGN PATENT DOCUMENTS

| | | | |
|---|---|---|---|
| EP | 0 476 353 A1 | 3/1992 | H01R/13/187 |
| FR | 1 130 596 | 2/1957 | |
| FR | 1 409 595 | 8/1965 | |
| GB | 963676 | 7/1964 | |
| WO | WO 98/31078 | 7/1998 | H01R/13/631 |

OTHER PUBLICATIONS

Copy of European Search Report.

* cited by examiner

*Primary Examiner*—Tulsidas Patel

(57) ABSTRACT

The present invention relates to an electrical connector having a male connector part and a female connector part, the male connector part having a contact pin and a first base member and the female connector part having a contact socket and a second base member, and the contact pin being insertable into the contact socket in order to effect electrical connection between the male connector part and the female connector part. In order to provide an electrical connector which compensates any offset between female connector part and male connector part resulting from assembly tolerances without damage thereto during mating, the contact pin and/or the contact socket is/are mounted movably in the respective base member. The contact socket is therefore protected against unintentional contact when the contact pin is not inserted, the female connector part also has closing elements, which close the contact socket, and the contact pin comprises an insertion bevel, which exerts uniform, radially outwardly directed mechanical pressure on the closing elements upon insertion of the contact pin into the contact socket and thereby releases the closing elements.

16 Claims, 17 Drawing Sheets

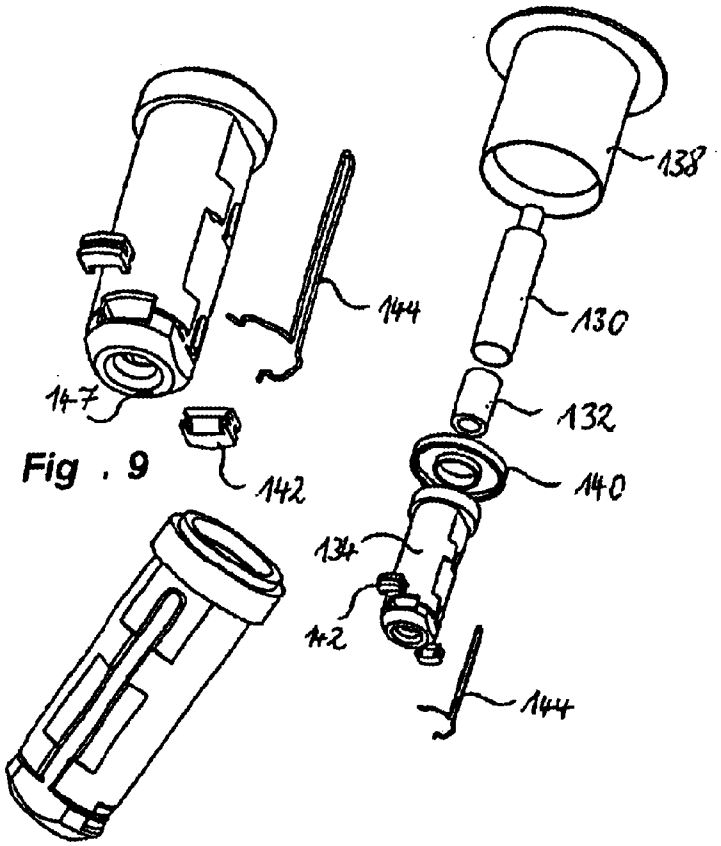
Fig. 9
Fig. 10
Fig. 11
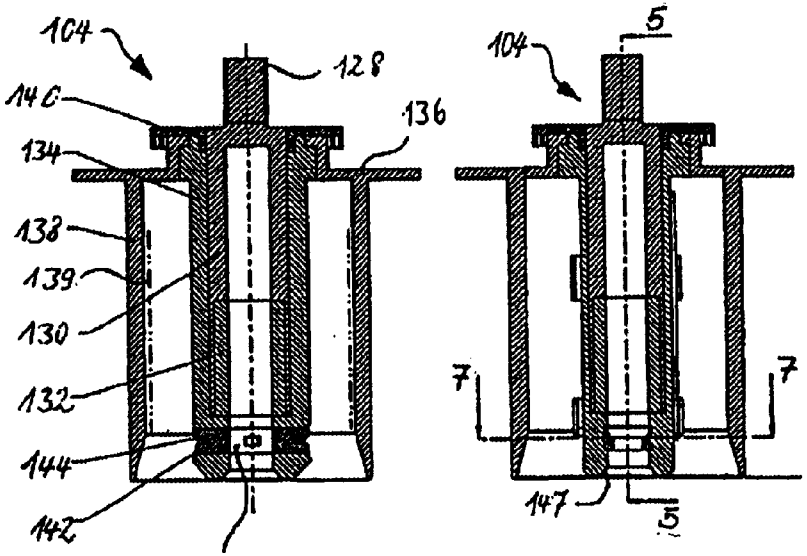
Fig. 5
Fig. 7
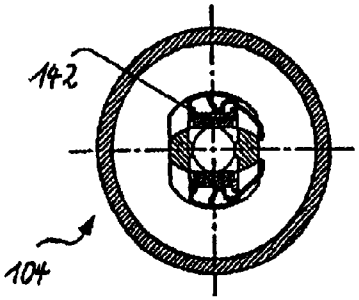
Fig. 8
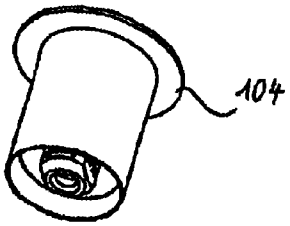
Fig. 6

148

148

148

ELECTRICAL CONNECTOR

FIELD OF THE INVENTION

The present invention relates to an electrical connector system having movably mounted contacts to accommodate misalignment between male and female connector parts.

DESCRIPTION OF THE PRIOR ART

Fuel cells are electrochemical systems, which convert the chemical energy from oxidation processes directly into electrical energy. This electrical energy has to be forwarded to the various devices via the power supply unit. In mobile applications in particular, the connection between fuel cell and power supply unit must occupy a minimum amount of space. In applications requiring a plurality of connectors, the male connector parts are generally mounted on the power supply unit and the female connector parts on the fuel cell. The respective manufacturing tolerances may however create positional variational or misalignment between male connector parts and female connector parts, which lead to damage to the connector. At the same time, due to the extremely harsh environmental conditions, the connector assemblies are required to withstand vibration, corrosion, and heat while maintaining current carrying capacity. In addition, the connection has to be capable of being frequently released and reliably reconnected with low insertion force.

Since the output voltages supplied by the fuel cell are direct current voltages of up to approx. 800 volts, the contact socket should be automatically closed in an unmated condition to avoid unintentionally inserted items.

An object of the present invention is therefore to provide an electrical connector which compensates any offset or misalignment between female connector part and male connector part resulting from manufacturing tolerances without damage thereto during mating. A further object with such connectors is to protect the contact socket from unintentional contact when the contact pin is not inserted therein.

SUMMARY OF THE INVENTION

The invention provides an electrical connector having a male connector part having a contact pin and a first base member, a female connector part having a contact socket and a second base member. The contact pin is insertable into the contact socket in order to effect electrical connection between the male connector part and the female connector part. At least one of the contact pin or the contact socket are mounted movably in the respective base member and precentred in the respective base member by means of a spring via a centring bevel, which is provided on the respective base member.

According to an embodiment of the invention, the contact pin has an insertion bevel at the end. The centring process during insertion of the contact pin into the contact socket is thereby simplified.

If an insertion cone is provided at the end of the contact socket, the centring process during insertion may be further simplified.

A particularly flexible, economic option for achieving movable mounting consists in mounting the contact pin and/or the contact socket in the respective base member with adequate play.

In order to achieve a central starting position for the movably mounted contact pin and/or contact socket, the contact pin and/or the contact socket may be precentred in the respective base member by means of a spring or a centring bevel, which is provided on the respective base member. Particularly suitable for this purpose is an angle of approx. 10° between the centring bevel and the cross-sectional plane of the connector.

According to another embodiment, the first base member and/or the second base member comprise(s) retaining projections on an inner side which interact with corresponding projections on the contact pin and/or the contact socket to prevent axial displacement of the contact pin and/or the contact socket. It is thereby ensured that the contact pin and/or the contact socket has/have sufficient mechanical stability for fitting together and release of the electrical connection.

In another embodiment of the invention, the connector assembly, it may be ensured that the contact socket is secured in the open state against undesired contact and the contact pin may easily open this securing means upon closure of the electrical connection. To this end, the contact pin comprises an insertion bevel, which exerts uniform, radially outwardly directed mechanical pressure on the closing element and thereby releases it.

According to another embodiment, the closing elements are held by a spring in the closed state when the contact pin is not inserted. It may thereby be ensured that the contact socket of the open electrical connector is always automatically protected against unintentional contact.

Particularly precise adjustability of the required spring forces is achieved by using a shaped wire spring. On the other hand, the use of a worm spring is particularly simple with regard to construction, since in this case only a simply produced annular receptacle needs to provided on the outside of the contact insulation to fix the spring in place.

Additional security against the penetration of very thin wires (diameter 1 mm, see IEC 529) is provided by an embodiment in which the female part of the electrical connector comprises a further closing element, which closes the contact socket and may be displaced in the axial direction once the contact pin has released the closing elements.

In order to bring this closing element also automatically into its securing position, as soon as a contact pin is no longer inserted, this further closing element may likewise be held by means of a spring.

According to another embodiment, the contact pin comprises a contact member and an insertion cap separate therefrom. In this way, it may be ensured that the insertion bevel, which is under particular mechanical stress during insertion of the contact pin, may be made of a particularly suitable material, which exhibits relatively poor electrical characteristics, however. In this embodiment, the actual contact member which produces the electrical connection may be made of the material best fulfilling these requirements.

By providing the contact socket with a contact tube and a separate locating bush, the contact pin is additionally centred by the locating bush and relatively large transverse forces are not transmitted to the contact tube but rather are absorbed by the locating bush.

Depending on the requirements made of the electrical connector, the respective features involved in movable mounting of contact pin and/or contact socket and in securing of the contact socket against unintentional contact may be used alone or in combination.

BRIEF DESCRIPTION OF THE DRAWINGS

The invention will be explained in more detail below with reference to the preferred embodiments illustrated in the attached drawings, in which:

FIG. 5 shows a section through a female connector part according to a first embodiment;

FIG. 6 is a view of the female connector part according to the first embodiment;

FIG. 7 shows a further section through the female connector part according to the first embodiment;

FIG. 8 shows a further section through the female connector part according to the first embodiment;

FIG. 9 is an exploded view of the female connector part according to the first embodiment;

FIG. 10 is a view of the female connector part according to the first embodiment;

FIG. 11 is an exploded view of the female connector part according to the first embodiment;

DETAILED DESCRIPTION OF THE PREFERRED EMBODIMENT

Figure 4:
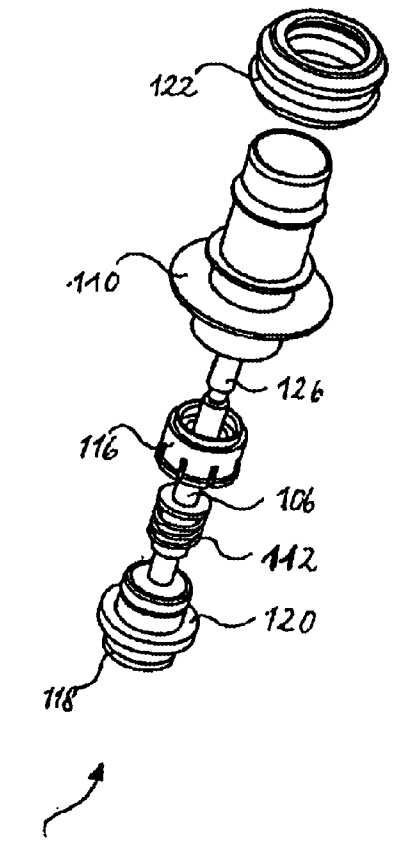
FIG. 4 is an exploded view of the male connector part of the electrical connector of the first embodiment.
Figure 2:
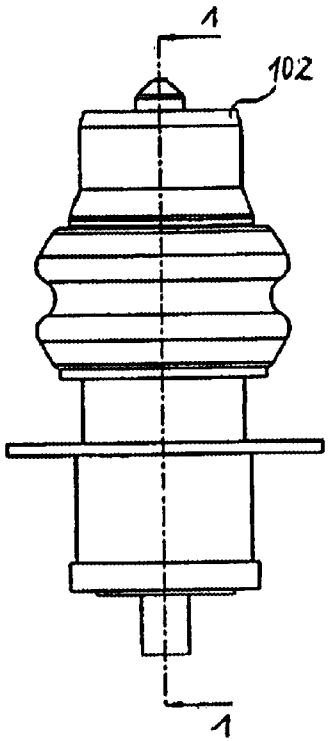
FIG. 2 is a view of the male connector part of the electrical connector of the first embodiment.
Figure 1:
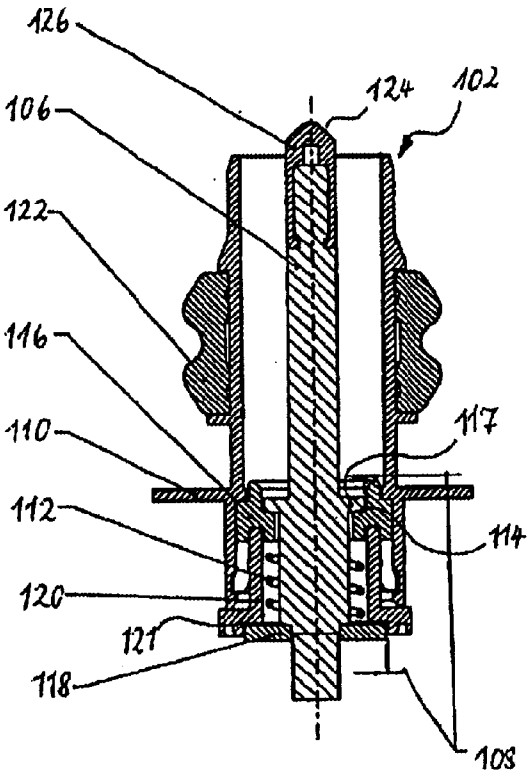
FIG. 1 shows a section through a male connector part of the electrical connector of a first embodiment.
Figure 3:
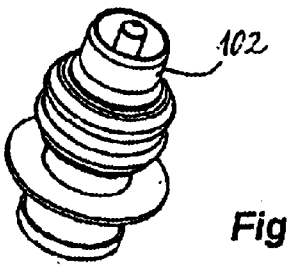
FIG. 3 is a further view of the male connector part of the electrical connector of the first embodiment.
Figure 15:
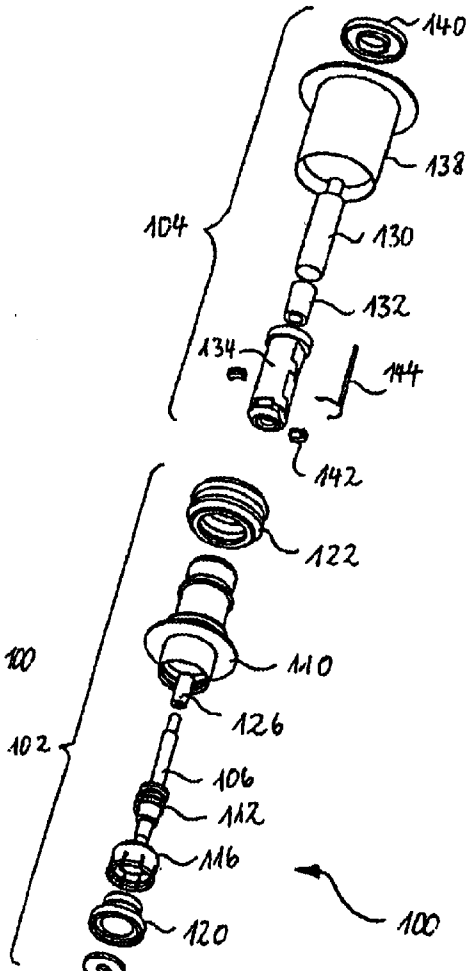
FIG. 15 is an exploded view of the entire connector of the invention according to the first embodiment.
Figure 14:
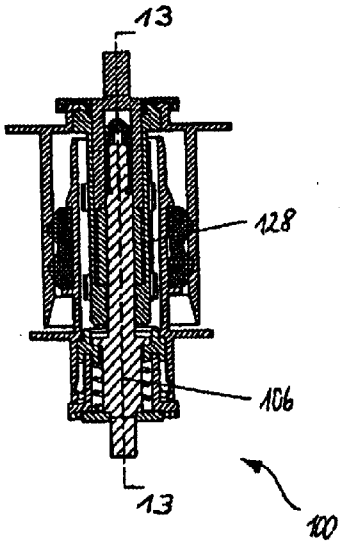
FIG. 14 shows a further section through the entire connector of the invention according to the first embodiment.
Figure 13:
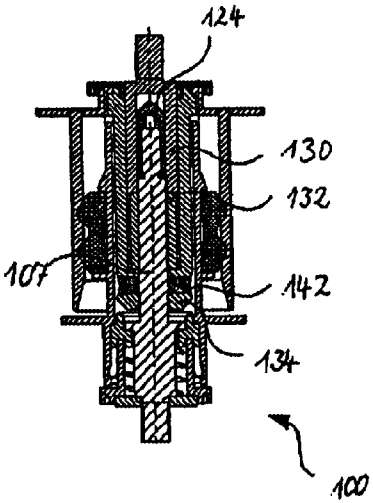
FIG. 13 shows a section through the entire connector of the invention according to the first embodiment.
Figure 12:
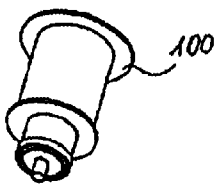
FIG. 12 is a view of the entire connector of the invention according to the first embodiment.

If electrical contact is to be established between a fuel cell and a power supply unit (Power Distribution Unit, PDU), a male connector part 102 according to the invention and shown in FIGS. 1 to 4 may serve to compensate any possible offset or misalignment between a female connector part 104 and the male connector part 102 due to manufacturing tolerances. According to the invention, a contact pin 106 is mounted in a base member 110 with sufficient play 108 for this purpose. A pressure spring 112 presses the contact pin 106 against a 10° bevel 114, which is provided on guide bushing 116 connected with the base member 110. The spring force of the pressure spring 112 aligns the contact pin 106 in a centred manner with the assistance of the centring bevel 114. The pressure spring 112 rests on the washer 118, which is firmly connected with the contact pin 106. Mechanical stability relative to axial load in both directions is achieved by interaction of the washer 118 with a corresponding retaining device on the pressure spring 112 and by the centring bevel 114 providing a limit stop for the contact pin 106.

The sealing ring 122, which is pushed over the base member, seals the electrical contact relative to the environment when the connector is fitted together. The contact pin 106 has insertion bevels 124 at its end. These simplify the centring process upon insertion of the contact pin 106 into the contact socket 128. The end area with the insertion bevel 124 takes the form of a push-on cap 126. It may thereby be ensured that different, particularly suitable materials may be used in each case for electrical contacting and for the insertion bevel 124.

FIGS. 5 to 11 show the associated female connector part 104 in a first embodiment. The female connector part 104 comprises a contact socket 128, into which the contact pin 106 may be inserted for electrical connection with the male connector part 102.

As best shown in section B—B of FIG. 5 and section A—A of FIG. 7, the contact socket 128 has a locating bushing 130 and a contact tube 132, which are embedded in contact insulator 134. The contact insulator 134 serves as a preliminary alignment feature for the contact pin 106 and is provided for this purpose with an insertion cone 147. When the contact pin 106 has been pushed through the contact tube 132 on insertion, it is additionally centred in the locating bushing 130. Relatively large transverse forces are thereby not transmitted to the contact socket 132 but rather are absorbed by the contact insulator 134 and the locating bushing 130.

The base member 136, which surrounds the contact socket 128 has shielding 138 formed by the housing of the fuel cell and has an inner coating 139 machined for contact with the sealing ring 122. An insulating disk 140 connects the shielding 138 with the contact insulator 134.

Closing elements 142, which are provided on the contact insulator 134, are compressed by a pretensioned closing spring 144, such that they close the insertion opening 146 when no contact pin 106 is inserted in the female connector part 104. The special three-dimensional form of the shaped wire spring 144 provides the necessary large spring travel and the necessary closing force. In principle, two separate closing springs 144 may also be used.

FIGS. 12 to 15 show the connector 100 according to the invention after mating. During the insertion process, mechanical pressure directed uniformly in the radially outwards direction is exerted on the closing elements 142 by the insertion bevel 124 on the contact pin 106 to open the closing elements 142. The contact pin 106 may then be fully inserted. Electrical connection is effected via the contact member 107 and the contact tube 132. The majority of the mechanical forces arising during centring of the movably mounted contact pin 106 is absorbed by the locating bushing 130 and the contact insulator 134. In this way, damage to the more sensitive contact tube 132 may be prevented.

FIGS. 16 to 26 show different, partially sectional views of a power supply unit 148 with the male connector part 102 of a connector 100 according to a second embodiment. As is clear for example from FIG. 16, the contact pin 106 is mounted movably in a guide bushing 116, as in the exemplary embodiment shown in FIG. 1. A pressure spring 112 ensures appropriate precentring by means of the centring bevel 114. In contrast to the embodiment shown in FIG. 1, the contact pin 106, as may be seen from FIG. 16 for example, comprises a substantially tubular securing pin receptacle 150, into which a securing pin 152, provided on the female connector part 104, may be inserted. The contact pin additionally has a mechanically stable cap 126 with insertion bevels 124.

Figure 16:
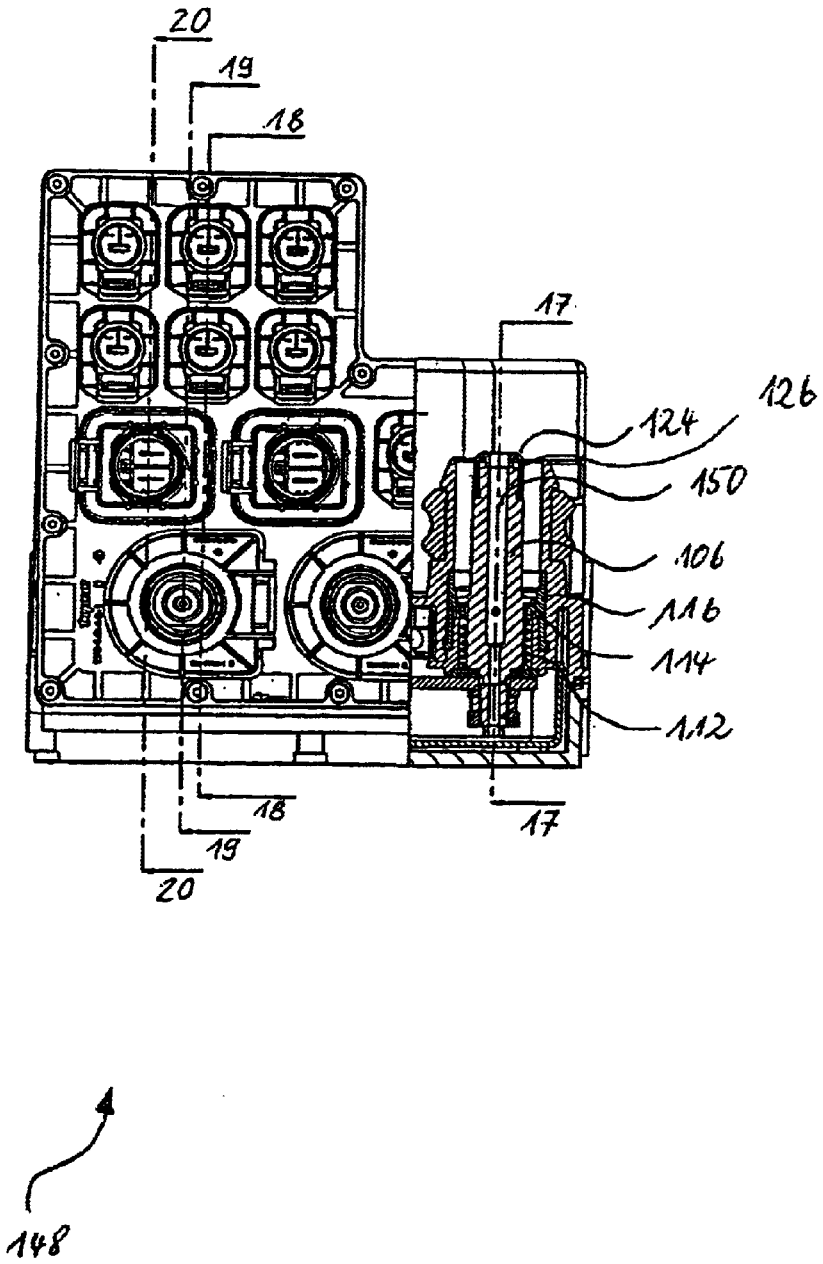
FIG. 16 is a partially sectional view of the power supply unit with a female connector part according to a second embodiment.
Figure 17:
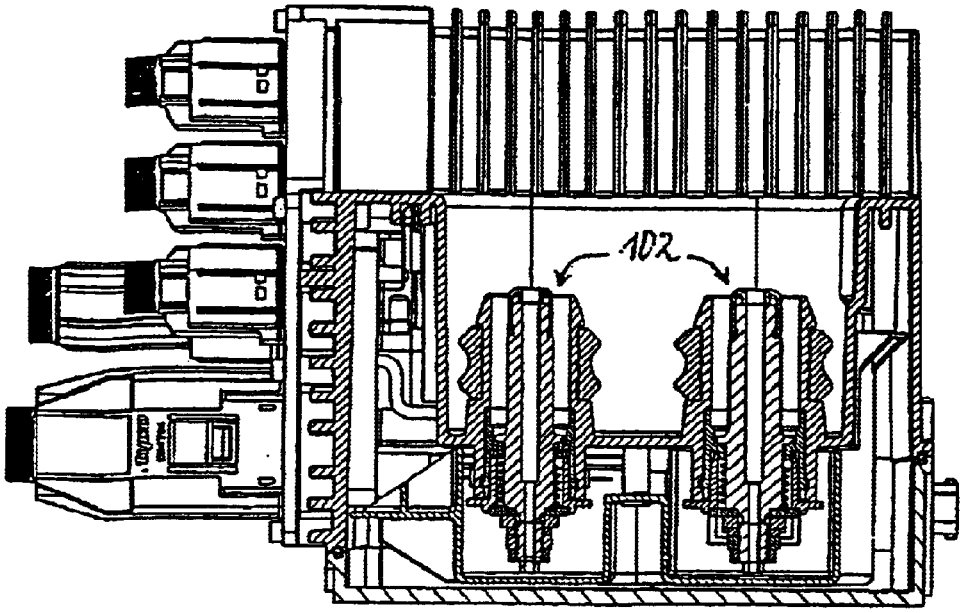
FIG. 17 is a further partially sectional view of the power supply unit with the female connector part according to the second embodiment.
Figure 18:
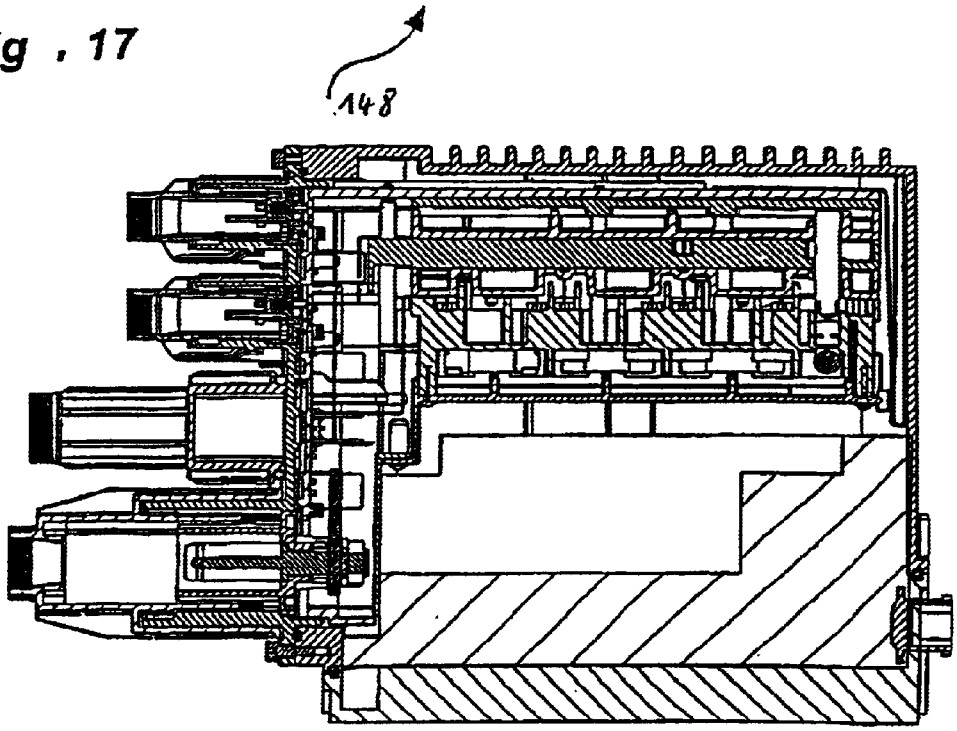
FIG. 18 is a further partially sectional view of the power supply unit with the female connector part according to the second embodiment.
Figure 19:
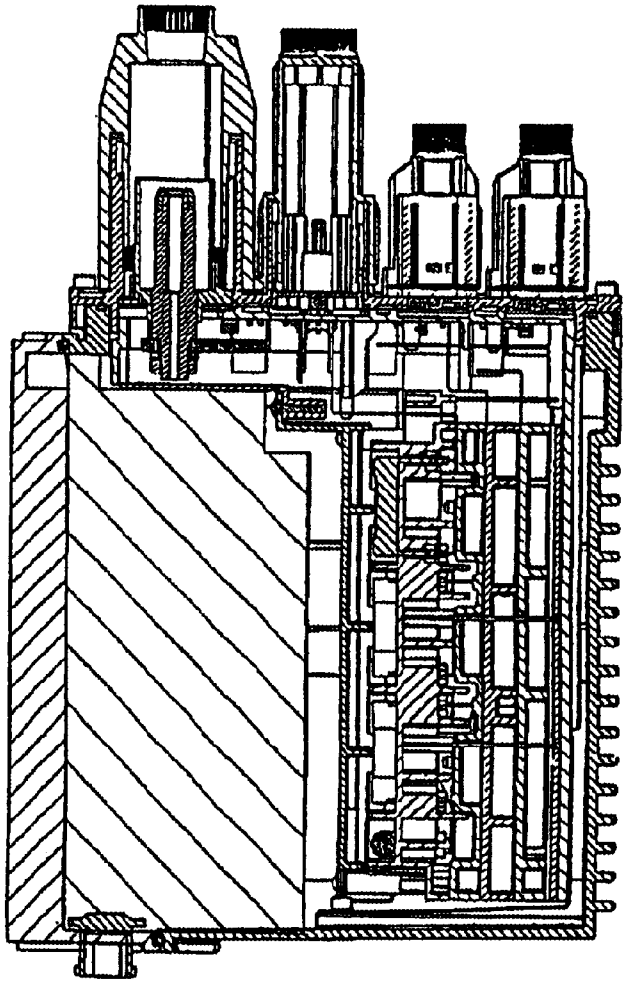
FIG. 19 is a further partially sectional view of the power supply unit with the female connector part according to the second embodiment.
Figure 20:
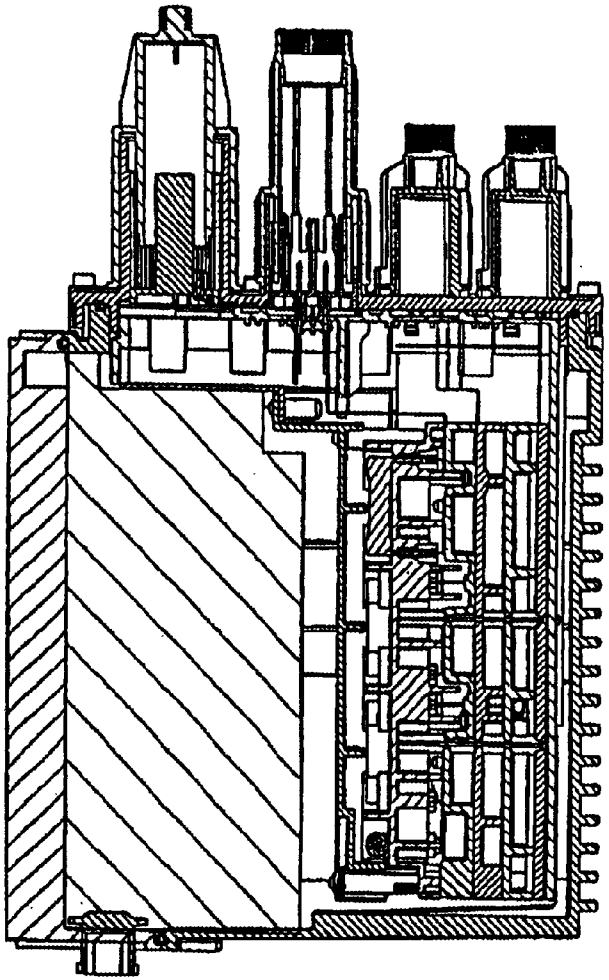
FIG. 20 is a further partially sectional view of the power supply unit with the female connector part according to the second embodiment.
Figure 21:
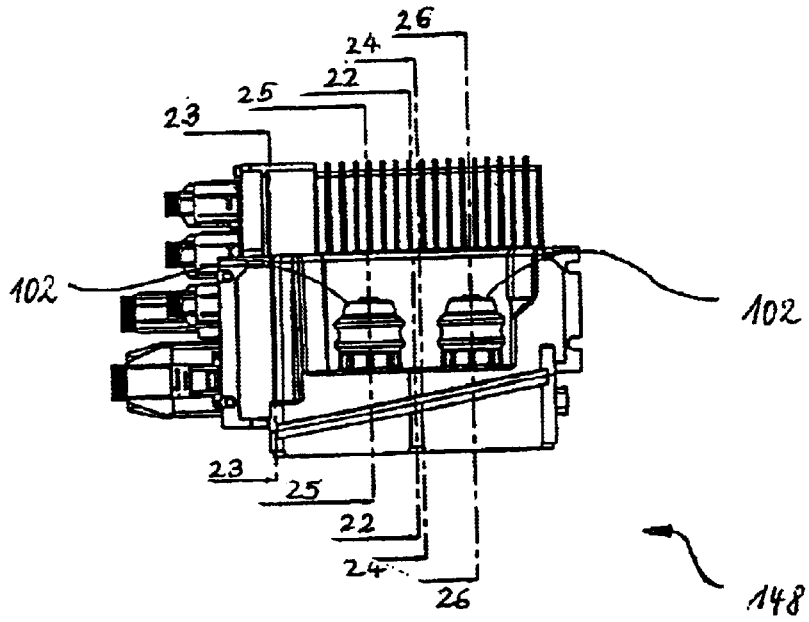
FIG. 21 is a further partially sectional view of the power supply unit with the female connector part according to the second embodiment.
Figure 22:
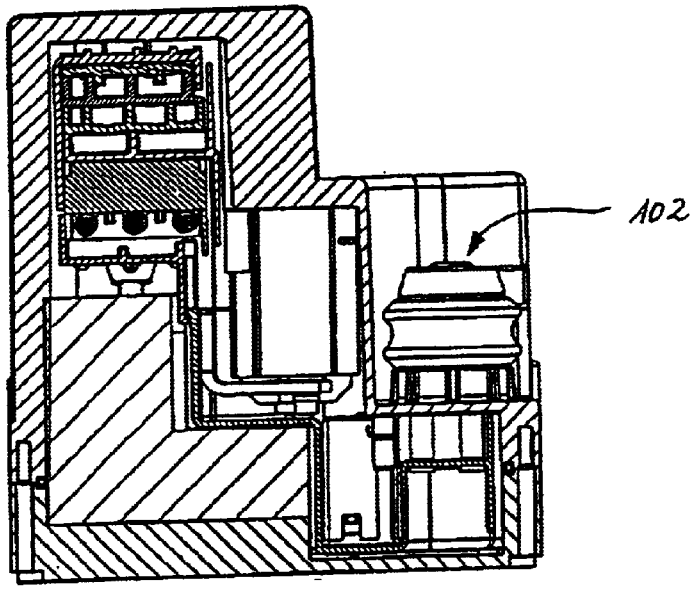
FIG. 22 is a further partially sectional view of the power supply unit with the female connector part according to the second embodiment.
Figure 23:
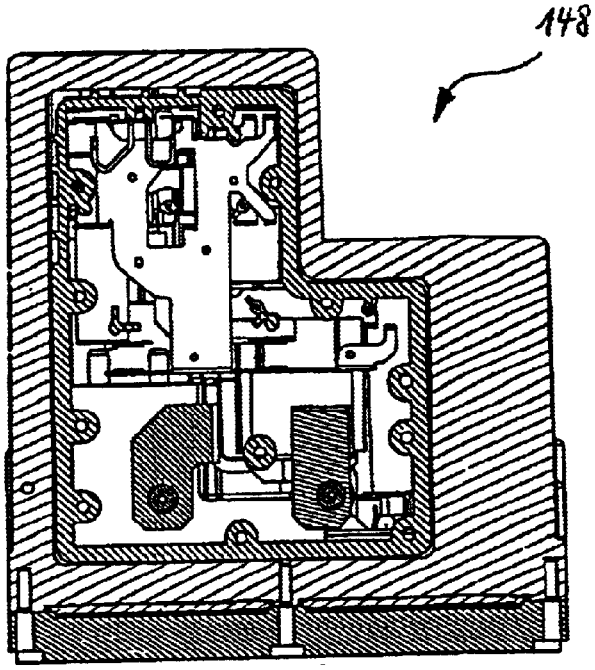
FIG. 23 is a further partially sectional view of the power supply unit with the female connector part according to the second embodiment.
Figure 24:
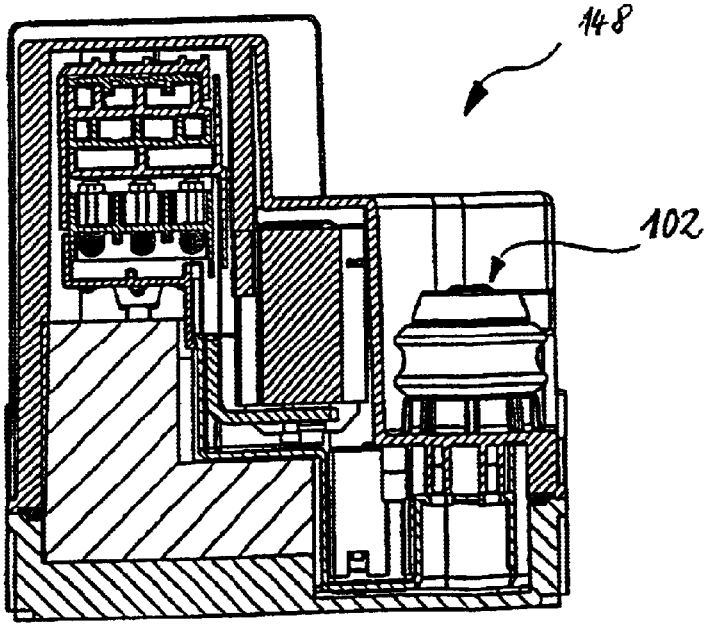
FIG. 24 is a further partially sectional view of the power supply unit with the female connector part according to the second embodiment.
Figure 25:
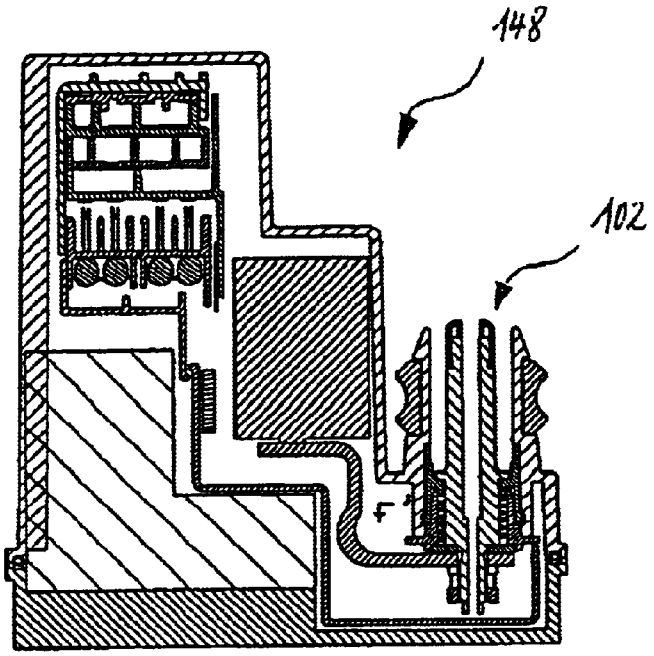
FIG. 25 is a further partially sectional view of the power supply unit with the female connector part according to the second embodiment.
Figure 26:
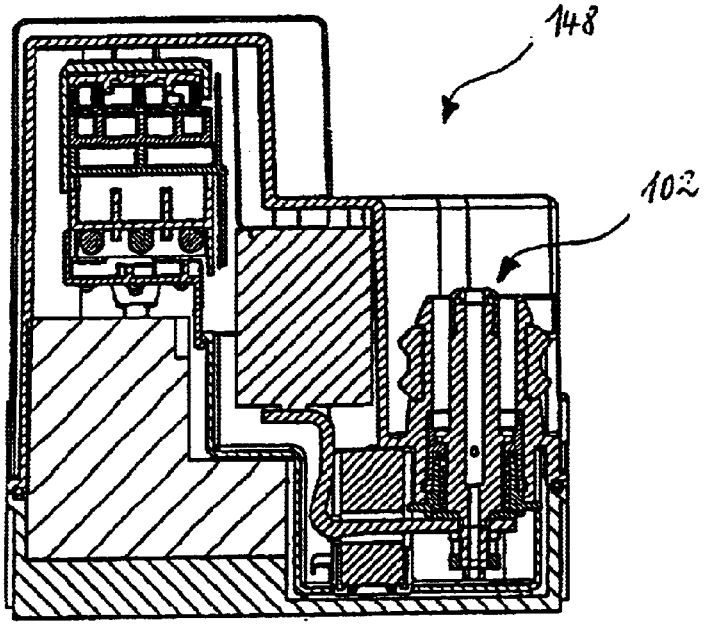
FIG. 26 is a further partially sectional view of the power supply unit with the female connector part according to the second embodiment.
Figure 27:
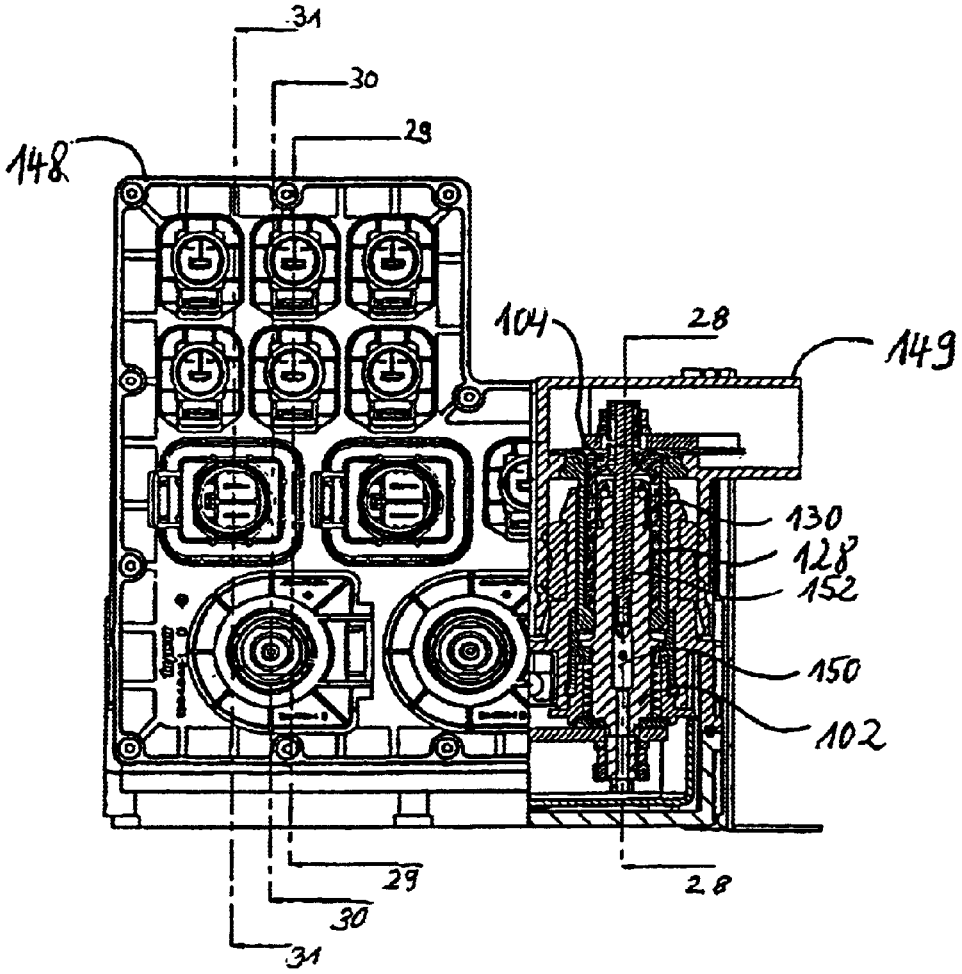
FIG. 27 is a partially sectional view of the power supply unit with the female connector part according to the invention and the associated male connector part according to the invention.
Figure 28:
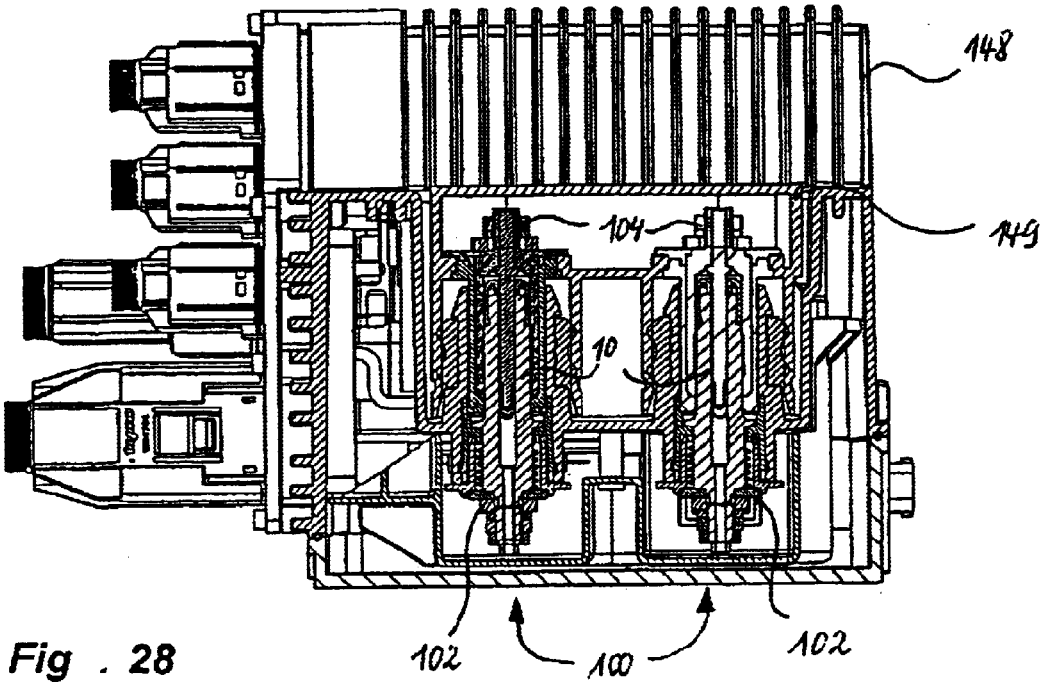
FIG. 28 is a further partially sectional view of the power supply unit with the female connector part according to the invention and the associated male connector part according to the invention.
Figure 29:
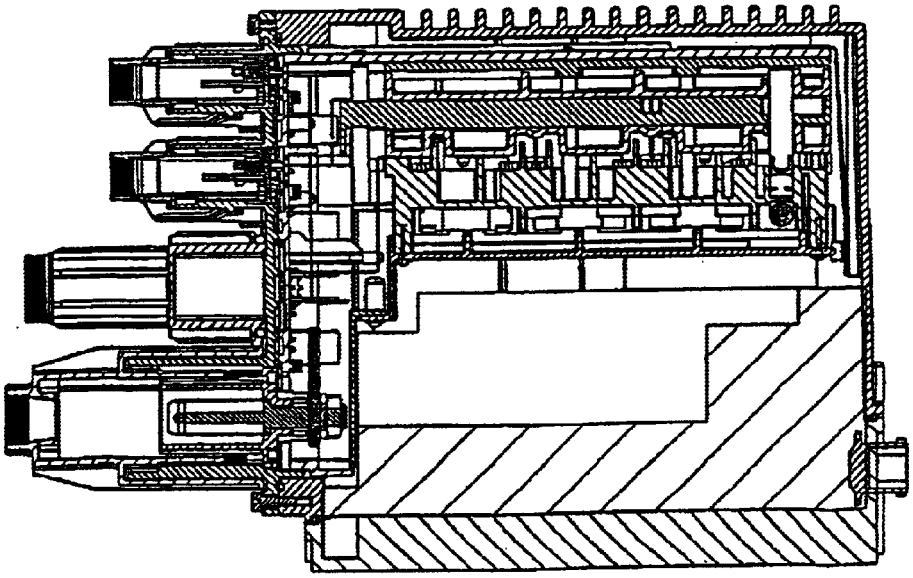
FIG. 29 is a further partially sectional view of the power supply unit with the female connector part according to the invention and the associated male connector part according to the invention.
Figure 30:
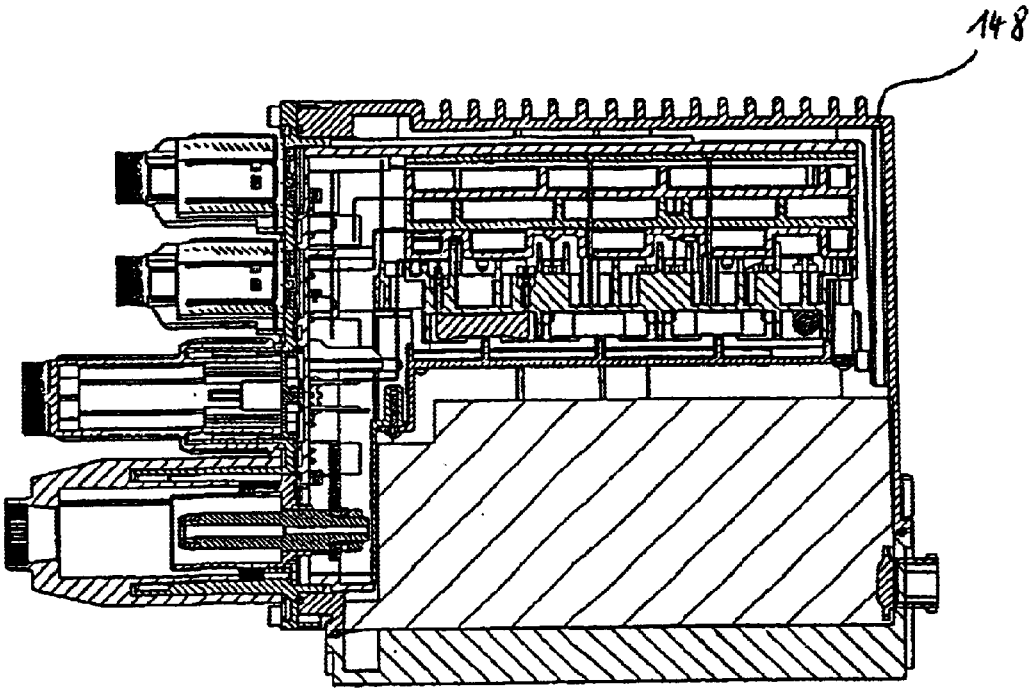
FIG. 30 is a further partially sectional view of the power supply unit with the female connector part according to the invention and the associated male connector part according to the invention.
Figure 31:
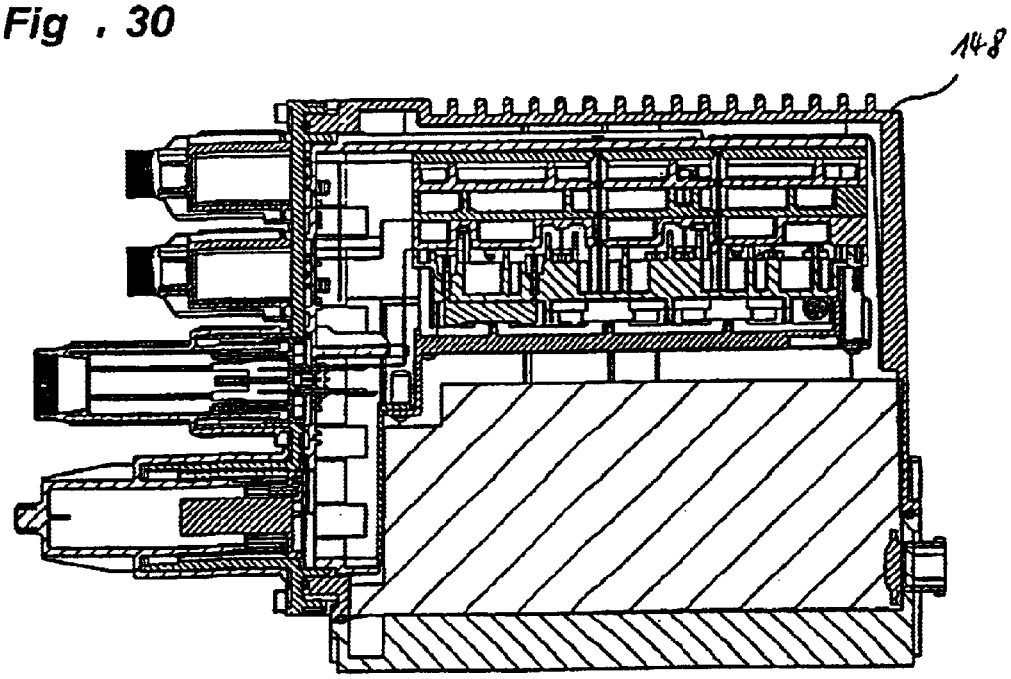
FIG. 31 is a further partially sectional view of the power supply unit with the female connector part according to the invention and the associated male connector part according to the invention.
Figure 32:
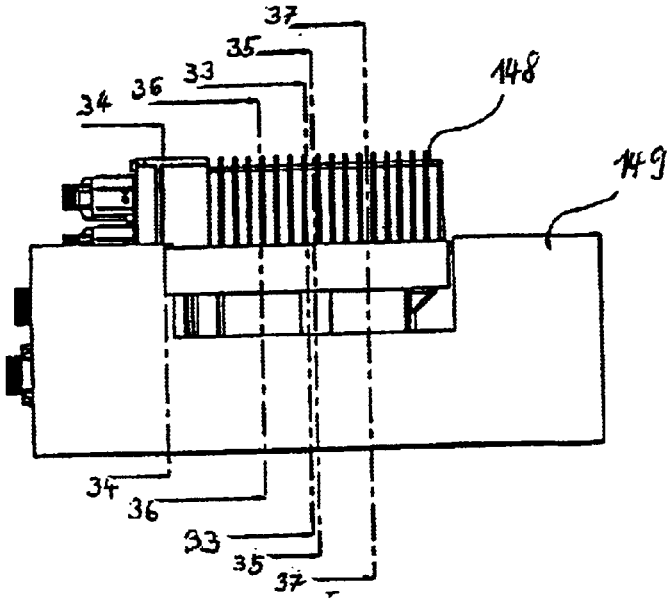
FIG. 32 is a further partially sectional view of the power supply unit with the female connector part according to the invention and the associated male connector part according to the invention.
Figure 33:
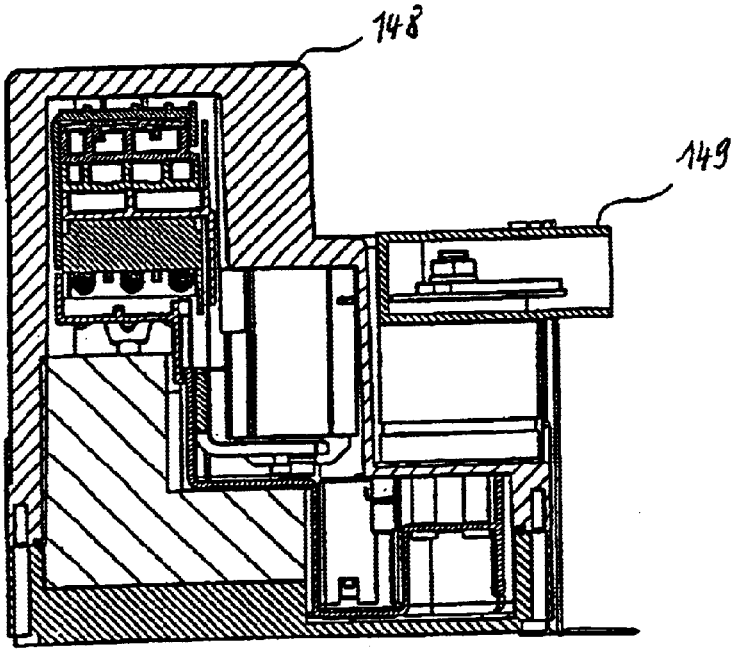
FIG. 33 is a further partially sectional view of the power supply unit with the female connector part according to the invention and the associated male connector part according to the invention.
Figure 34:
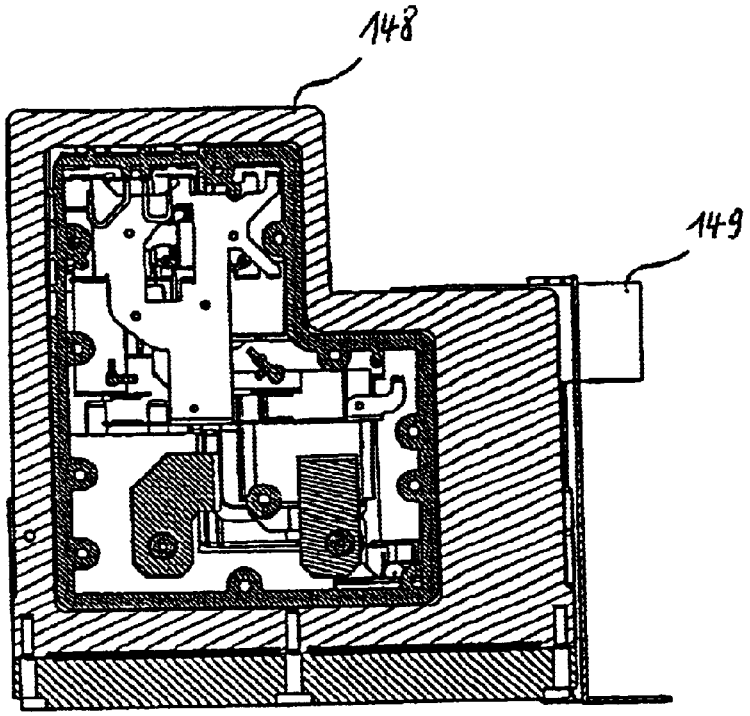
FIG. 34 is a further partially sectional view of the power supply unit with the female connector part according to the invention and the associated male connector part according to the invention.
Figure 35:
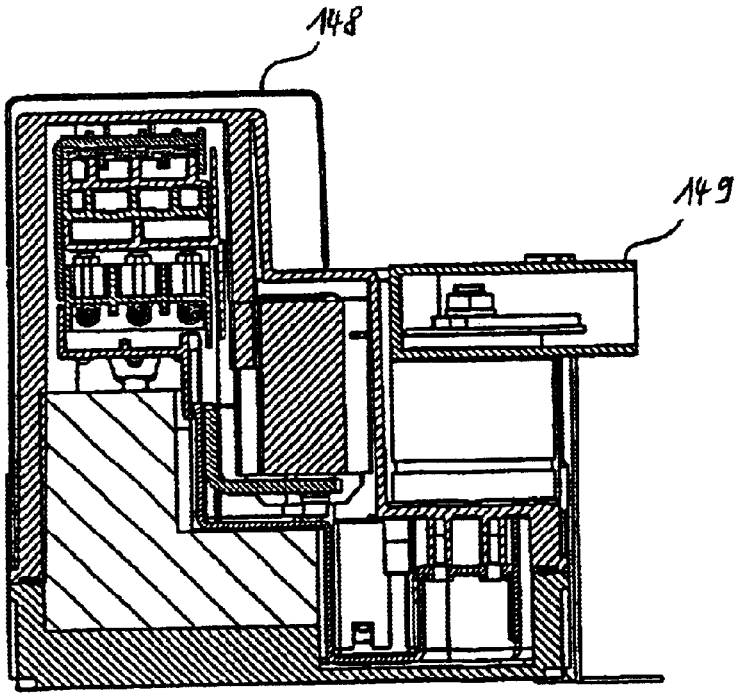
FIG. 35 is a further partially sectional view of the power supply unit with the female connector part according to the invention and the associated male connector part according to the invention.
Figure 36:
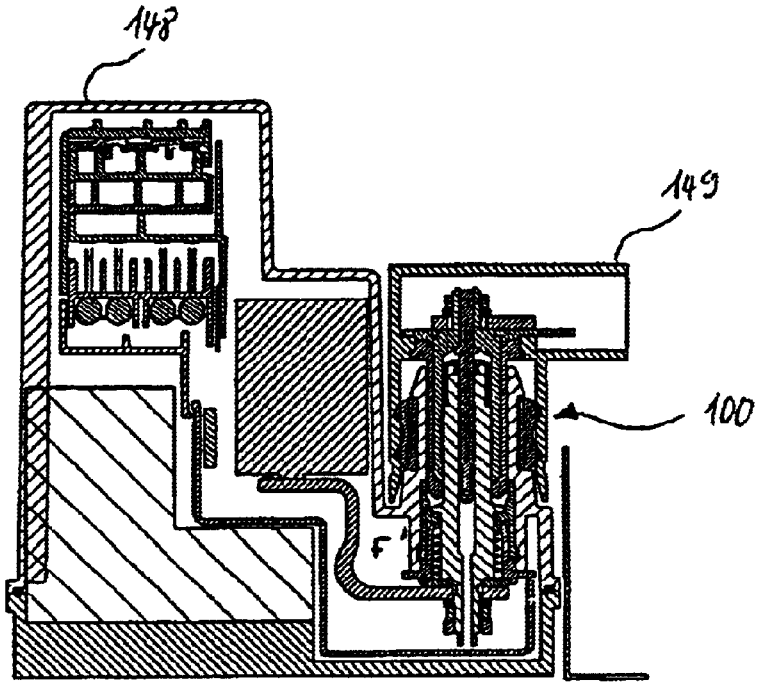
FIG. 36 is a further partially sectional view of the power supply unit with the female connector part according to the invention and the associated male connector part according to the invention.
Figure 37:
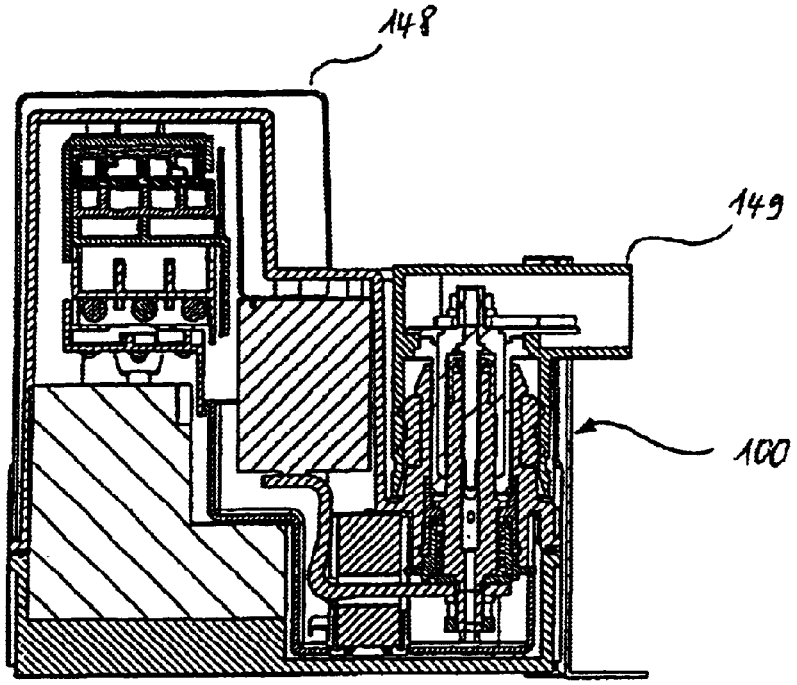
FIG. 37 is a further partially sectional view of the power supply unit with the female connector part according to the invention and the associated male connector part according to the invention.
Figure 41:
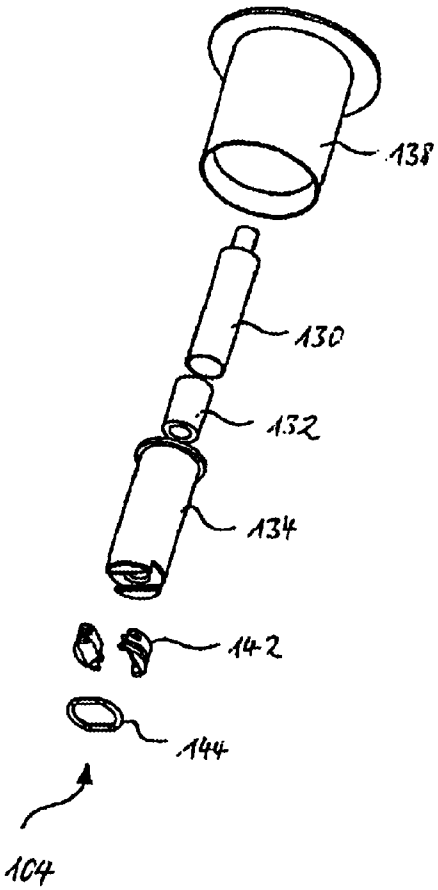
FIG. 41 is an exploded view of the female connector part according to the third embodiment.
Figure 39:
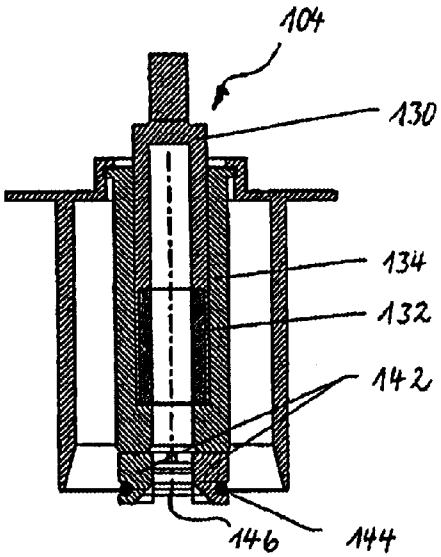
FIG. 39 shows a further section through a female connector part according to the third embodiment.
Figure 38:
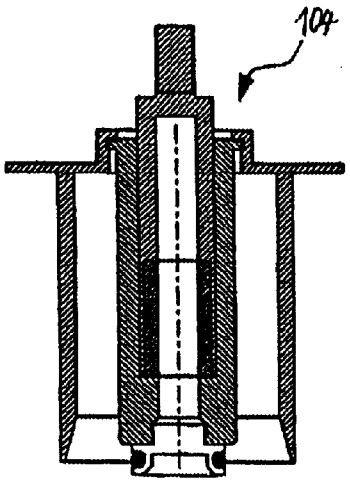
FIG. 38 shows a section through a female connector part according to a third preferred embodiment.
Figure 40:
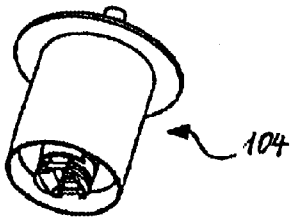
FIG. 40 is a view of the female connector part according to the third embodiment.
Figure 45:
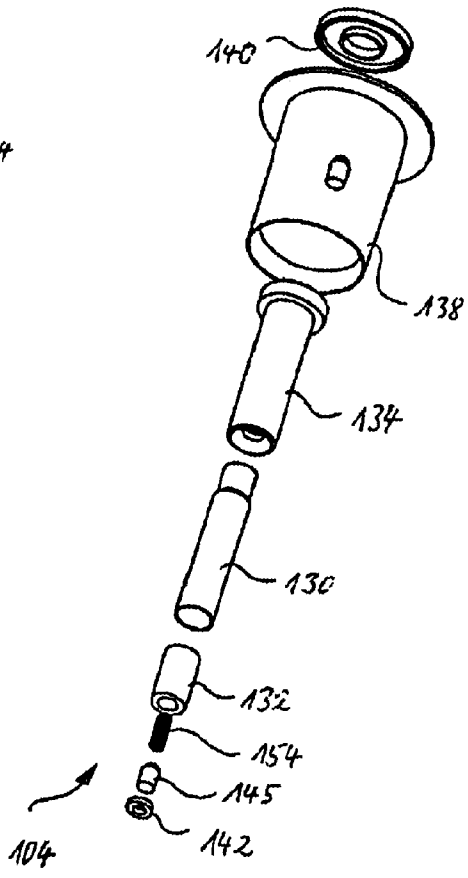
FIG. 45 shows an exploded view of the female connector part according to the fourth embodiment.
Figure 43:
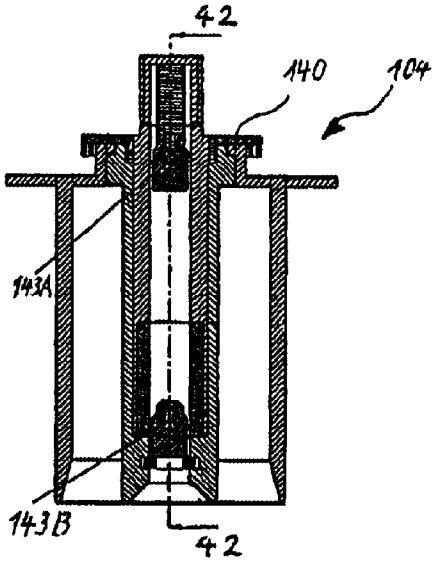
FIG. 43 shows a further section through the female connector part according to the fourth embodiment.
Figure 42:
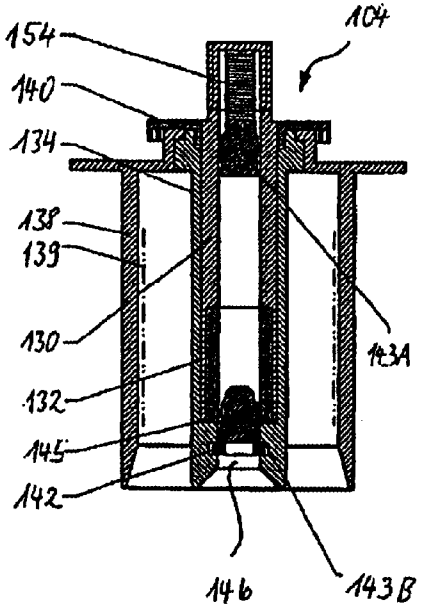
FIG. 42 shows a section through a female connector part according to a fourth embodiment.
Figure 44:
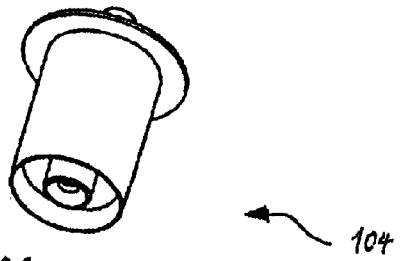
FIG. 44 is a view of the female connector part according to the fourth embodiment.

FIGS. 27 to 37 show the power supply unit 148 of FIG. 16 with inserted female connector part 104, which is coupled with the fuel cell 149. As in the embodiment illustrated in FIG. 5, the contact socket 128 has a locating bushing 130 and a contact tube 132. In addition, a securing pin 152 is provided on the female connector part 104, which may be inserted into the securing pin receptacle 150 of the male connector part 102. As is clear from FIG. 28, two connector assemblies 100 are necessary for making contact between power supply unit 148 and fuel cell 149. Since both the position of the two male connector parts 102 on the power supply unit 148 and the position of the two female connector parts 104 on the fuel cell 149 are fixed during their respective manufacture, it is extremely important for any mismatch caused by manufacture between the real and ideal axes of the connector to be capable of compensation by the movable mounting of the contact pin 106.

FIGS. 38 to 41 show a third embodiment of the female connector part 104 according to the invention. In contrast to the embodiment shown in FIGS. 5 to 11, a resilient ring is used as a closing spring 144 for the closing elements 142 in the case of the female connector part 104 shown in FIGS. 38 to 41. This resilient ring 144 takes the form of a worm spring. Worm springs are tension springs which are connected at the ends to produce a ring and as a rule are made from spring steel helices. Due to the tensile force of the closing spring 144, the closing elements 142 are pressed radially inwards and close the insertion opening 146, if no contact pin 106 is inserted therein.

A further embodiment of the female connector part 104 is shown in FIGS. 42 to 45. In this variant, a substantially cylindrical further closing element 145 closes the insertion opening 146. When the contact is closed, the further closing element 145 is pressed against the pressure spring 154 and is located in position 143A. If no contact pin 106 is inserted, the further closing element 145 is pressed by the pressure spring 154 into the position 143B. In this way, the closing element 142 forms a limit stop for the further closing element 145. In the present embodiment, this closing element 142 is itself resilient and requires no additional closing spring in order to be compressed. The contact pin 106 is in a position, due to its insertion bevel 124, to open the closing element 142 by uniform pressure directed radially outwards. Due to a lack of insertion bevels on the further closing element 145, the latter is trapped inside the contact.

Although the exemplary embodiments in the drawings show the contact pin and contact socket with circular cross sections, the present invention may also be applied to contact pins and contact sockets of rectangular cross section.

The connector is shown in the embodiments illustrated as a shielded connector. The construction according to the invention may also be applied to an unshielded connector, however. In the case of the unshielded variant, the number of necessary components could even be reduced.

An advantage of the connector according to the invention consists in the fact that any offset of the axes of contact pin and contact socket upon fitting together of the two parts is compensated by mounting the contact pin and/or contact socket movably in the respective base member. In this way, damage to the contact socket may be prevented.

We claim:

1. An electrical connector comprising a male connector part having a contact pin and a first base member, a female connector part having a contact socket and a second base member, and the contact pin being insertable into the contact socket in order to effect electrical connection between the male connector part and the female connector part, the contact socket being embedded in a contact insulator formed to receive the contact pin prior to insertion into the contact socket, and the contact pin being mounted movably in the first base member and precentred in the first base member by means of a spring and a centring bevel, which is provided on the first base member.

2. An electrical connector according to claim 1 wherein the contact pin comprises an insertion bevel at one end.

3. An electrical connector according claim 2 wherein the contact socket comprises an insertion cone at one end.

4. An electrical connector according to claim 3 wherein the contact pin or the contact socket are mounted with play in the respective base member.

5. An electrical connector according to claim 1 wherein the centring bevel forms an angle of 10° with a cross-sectional plane of the connector.

6. An electrical connector according to claim 3 wherein at least one of first or second base member comprises on an inner side retaining projections which interacts with corresponding projections on the contact pin or the contact socket, in order to prevent axial displacement of the contact pin or the contact socket.

7. An electrical connector comprising:

a male connector part having a contact pin and a first base member, a female connector part having a contact socket and a second base member, the contact pin being insertable into an opening in the contact socket in order to effect electrical connection between the male connector part and the female connector part, at least one closing element adjacent to the opening, which closes the contact socket, and the contact pin comprises an insertion bevel, which, upon insertion of the contact pin into the contact socket, interacts with the closing element for release thereof.

8. An electrical connector according to claim 7 wherein the closing element is held in a closed state by means of a spring.

9. An electrical connector according to claim 8 wherein the spring is a shaped wire spring.

10. An electrical connector according to claim 8 wherein the spring is a worm spring.

11. An electrical connector according to claim 10 wherein the female connector part comprises a further closing element, which closes the contact socket and may be displaced in the axial direction after release of the closing elements by the contact pin.

12. An electrical connector according to claim 11 wherein the further closing element is held in a position near to the closing element by means of a spring if the contact pin is not inserted.

13. An electrical connector according to claim 12 wherein the contact pin comprises a contact member and an insertion cap separate therefrom.

14. An electrical connector according to claim 13 wherein the contact socket comprises a contact tube and a locating bushing separate therefrom.

15. An electrical connector according to claim 7 further comprising a contact insulator surrounding the socket contact for pre-aligning the contact pin for insertion into the contact socket.

16. An electrical connector according to claim 13 wherein the at least one closing element is provided on the contact insulator.

* * * * *